US009677211B1

(12) United States Patent
Damour

(10) Patent No.: US 9,677,211 B1
(45) Date of Patent: Jun. 13, 2017

(54) STRETCH END CAP SUB-ASSEMBLY FOR SPREADER ROLLS

(71) Applicant: Converter Accessory Corporation, Wind Gap, PA (US)

(72) Inventor: Jeffrey C. Damour, Wind Gap, PA (US)

(73) Assignee: Converter Accesory Corporation, Wind Gap, PA (US)

( * ) Notice: Subject to any disclaimer, the term of this patent is extended or adjusted under 35 U.S.C. 154(b) by 237 days.

(21) Appl. No.: 14/524,706

(22) Filed: Oct. 27, 2014

Related U.S. Application Data

(60) Provisional application No. 61/895,871, filed on Oct. 25, 2013.

(51) Int. Cl.
*D06C 3/06* (2006.01)
*B65H 75/18* (2006.01)

(52) U.S. Cl.
CPC ..... *D06C 3/06* (2013.01); *B65H 75/185* (2013.01); *B65H 2404/17* (2013.01)

(58) Field of Classification Search
CPC .... D06C 3/06; D06C 3/062; B65H 2404/173; B65H 2404/1317; B65H 2404/132; B65H 2404/137; B65H 2404/17; B65H 2404/11; B65H 2404/1141; B65H 2404/1375; B65H 75/185; B65H 75/187; C03B 35/186; Y10T 29/49556
USPC ..... 26/104, 99, 100, 97; 492/20, 47, 48, 22; 101/415.1; 242/571, 571.8, 580, 586
See application file for complete search history.

(56) References Cited

U.S. PATENT DOCUMENTS 1,545,897 A * 7/1925 Haynes ..... H04N 1/08 346/138
4,194,275 A * 3/1980 Freuler ..... B65H 23/0251 26/100
4,625,376 A * 12/1986 Schiel ..... D21F 3/08 492/22
4,862,565 A * 9/1989 Damour ..... D06C 3/06 26/99
4,864,704 A * 9/1989 Hogan ..... F16C 13/00 193/37
5,141,601 A * 8/1992 Karlsson ..... D21F 3/0245 162/272
5,461,760 A * 10/1995 Damour ..... D06C 3/06 26/100
5,476,437 A * 12/1995 Damour ..... B65G 39/02 492/47
8,075,465 B2 * 12/2011 Verfaellie ..... D21G 1/0226 492/21

(Continued)

*Primary Examiner* — Amy Vanatta
(74) *Attorney, Agent, or Firm* — Clinton H. Wilkinson; Charles A. Wilkinson

(57) ABSTRACT

An end cap sleeve stretch sub-assembly for holding the ends of the sleeve portion of a spreader roller assembly being rotatable on a stationary shaft, including a pivot arm assembly for adjusting the angular displacement of the end cap assembly with respect to an axis of the shaft in order to expand and contract sections of the roller assembly resilient sleeve, an outer bearing ring and bearing assembly including a slide ring which is adapted for slidable adjustment parallel to an axis of the shaft on the outer bearing ring in order to preload the end cap sub-assembly by adjusting the tension on the sleeve, and a clamping assembly for securely attaching the sleeve portion to the outer slide ring.

19 Claims, 2 Drawing Sheets

(56) References Cited

U.S. PATENT DOCUMENTS

2002/0065180 A1* 5/2002 Daily ..... C03B 35/186
492/47

* cited by examiner

STRETCH END CAP SUB-ASSEMBLY FOR SPREADER ROLLS

FIELD OF THE INVENTION

The present invention relates to mechanical end units for wrinkle removing spreader rolls used for stretching a traveling web to remove wrinkles. In particular, the mechanical unit that is the subject of this invention is an end cap sub-assembly for preloading and then adjusting the tension on expanding surface type wrinkle removing spreader rolls.

BACKGROUND OF THE INVENTION

Spreader rolls are used to address the problem of removing wrinkles from a rolled web of a flexible material, such as paper, cloth, film, foil, plastics, and nonwovens. Conventional spreader rolls typically include a bowed or unbowed stationary shaft on which an elastomer sleeve is rotatably mounted. One area of the sleeve outer surface is expanded with respect to an opposite area such that as the web material is passed across the sleeve surface from the less expanded to more expanded portion, the web is similarly expanded to remove wrinkles.

While these spreader rolls are useful in removing wrinkles from the center of the web, often the opposite lateral edges of the web remain wrinkled since the spreader rolls do not properly expand the web of material along its edges. These wrinkled edges therefore must be trimmed or otherwise removed, which creates a substantial amount of waste. In addition, the amount of expansion or contraction in most existing spreader rolls is difficult to adjust and requires a significant amount of machine downtime.

U.S. Pat. No. 5,461,760 issued to L. Damour represents a significant advance in the art in that it discloses a sleeve stretcher assembly that allows for proper initial adjustment of the tension on the resilient flexible sleeve of the roller assembly using only ordinary tools. This sleeve stretcher assembly thus allows the resilient sleeve member to be adjusted as needed, and in addition the sleeve member can be replaced when worn without requiring the entire roller assembly to be returned to the factory for proper mounting and initial adjustment of a new sleeve. As a result, the amount of machinery downtime was very significantly reduced and associated increases in productivity were realized.

In the Damour '760 patent, bores are provided in the ends of the stationary shaft forming part of the roller assembly, in which bores a slide rod is secured. A hub member is then pivotally connected to the slide rod by a pivot means. The present inventor has now developed an alternative arrangement for incorporating a slide mechanism into an end cap assembly that does not require bores to be formed in the ends of the stationary shaft, and that is less expensive to manufacture. The present invention therefore provides an end cap assembly including a pivot arm that better clamps and retains the end of a rubber sleeve in the clamping assembly. In addition, the present invention provides a pre-load assembly that allows the tension on the ends of the roller sleeve to be set to an initial setting and then adjusted or tightened later without any machine downtime using only standard tooling, and whereby the adjustments can be made on each end of the roller assembly independently.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF SUMMARY OF THE INVENTION

A stretch end cap sub-assembly is provided for use with rotatable stretch or expanding surface rollers of a type used for removing wrinkles, folds, and the like from fast-traveling webs of material such as fabrics, plastics and combinations thereof. A typical stretch roller assembly to be used with the end cap sub-assembly of the present invention includes a stationary, straight, rigid, and non-rotating or turning supporting shaft which is carried by support blocks, and including a resilient rotatable outer sleeve having a straight, uninterrupted surface usually made of rubber or elastomeric compounds, which sleeve in use is rotating at the same peripheral speed as the traveling web. In one embodiment, the outer sleeve is supported by a series of rubber discs each carried on a rotatable inner tube member mounted on the rigid shaft. The roller may be supported and positioned to provide different wrap angles with respect to the web material ranging from about ninety to about one hundred eighty degrees.

At least one end of the roller assembly outer tubular sleeve is retained by the stretch end cap sub-assembly of the present invention. The end cap sub-assembly includes a pivot arm mechanism used to adjust the tilt of an axis of the end cap sub-assembly with respect to the axis of the stationary shaft and flexible sleeve, which allows the surface of the flexible sleeve to be alternatingly expanded and contracted. An outer bearing ring and bearing assembly including a slide ring adapted for slidable movement parallel to an axis of the stationary shaft is also provided on the pivot arm, which is used in combination with a clamping assembly for securing the end of the sleeve to the end cap sub-assembly, and with a mechanism for preloading the rubber sleeve upon initial mounting.

In use, a web material is aligned so that it initially contacts the roll at the point where the sleeve expansion begins, and exits at a point prior to sleeve contraction, which causes a spreading action of the web material without distortion of the web. The amount of spreading is controlled both by the wrap angle of the material on the roller, which can be up to one hundred eighty degrees, and the adjusted angular displacement of the end caps using the pivot arm mechanisms.

The outer bearing ring has a cylindrical section and a circumferential flange on one end of the cylindrical section. An outer bearing ring bearing is located on the inner surface of the cylindrical section of the outer bearing ring, and an outer bearing slide ring is located on the outer surface of the cylindrical section. The outer bearing slide ring is slidable on the outer surface of the cylindrical section of the outer bearing ring. An end of the sleeve portion of the resilient sleeve is placed over the outer peripheral portion of the slide ring, and a segmented ring clamp and end cap is placed over the sleeve end to secure it to the end cap assembly between the clamping ring and the outer peripheral portion of the slide ring using a collet action.

A coupler ring is provided which is attached to the clamping mechanism end cap, and one or more fasteners join between the coupler ring and the slide ring. By adjusting the position of the fasteners the position of the slide ring on the circumferential outer surface of the outer bearing ring can be adjusted, thereby enabling the tension on the sleeve member to be adjusted. The linear position of the slide ring section of the outer bearing ring and bearing assembly on the stationary shaft is set during preloading of the sleeve and may be adjusted to increase the tension on the sleeve while the web is moving. A locking screw in the pivot arm mechanism is used to adjust the tilt of the end cap assembly with respect to the stationary shaft to expand one portion of the sleeve member while contracting another portion. The slide mechanism for preloading the rubber sleeve, the clamping mechanism, and pivot arm thus allow the amount of stretch of the end portions of the roller sleeve to be easily and selectively adjusted without requiring any special tools or the like. The present invention therefore provides for independent edge to edge adjustability of the roller to be realized while the web is in motion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
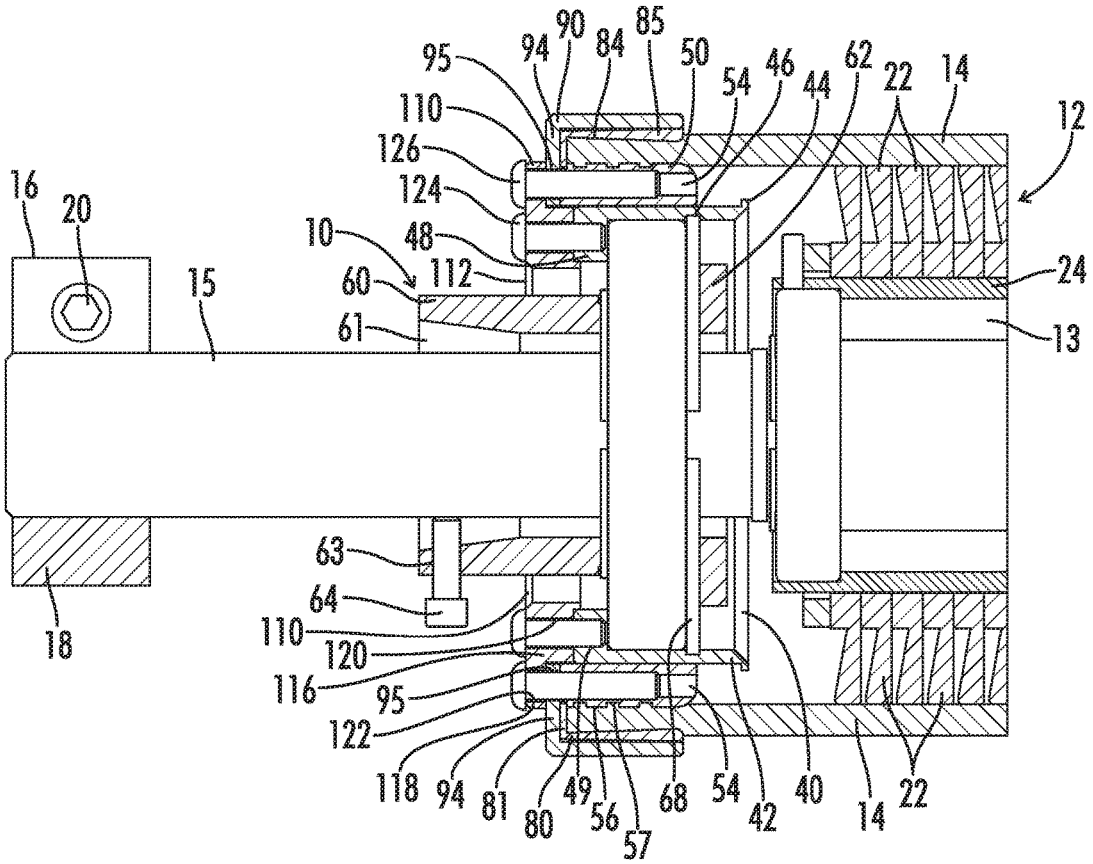
FIG. 1 is a partial cross sectional top view of a stretch end cap sub-assembly in an embodiment of the present invention.

As shown in the drawings, a stretch end cap sub-assembly 10 for retaining the end of a stretchable or resilient rubber outer sleeve of a spreader roller assembly 12 of a type used to stretch and remove wrinkles, ripples, bags, or torque marks from fast moving webs of material is provided. FIG. 1 illustrates a section of a typical spreader roll assembly 12 which includes a stationary cylindrical straight center shaft 13 having a generally tubular structure and a resilient outer rubber sleeve 14. In one embodiment both ends of rubber sleeve 14 are connected to an end cap sub-assembly 10 in accordance with the present invention, while in another embodiment the stretch end cap sub-assembly 10 may be utilized on only one end of rubber sleeve 14.

Figure 2:
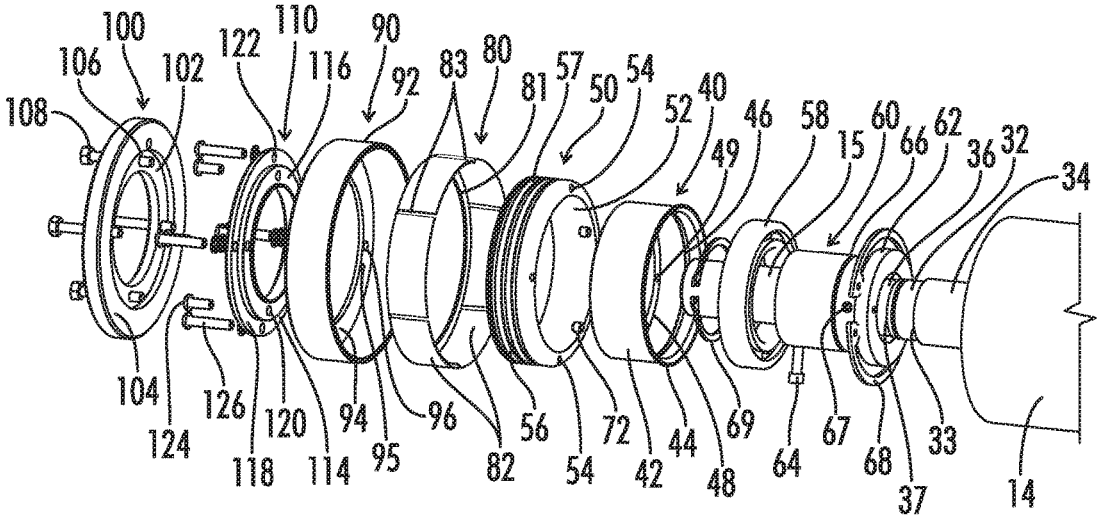
FIG. 2 is an exploded view of the stretch end cap sub-assembly shown in FIG. 1.

Sleeve 14 is of a selected length to accommodate the width of a fast-traveling web of material over the surface of which sleeve the material is passed to maintain the material straight and in the present embodiment to remove any wrinkles in the web. In one embodiment, sleeve 14 is made of 50 durometer neoprene. Shaft 13 has a length from end to end that is greater than the length of the sleeve 14, leaving the end portions 15 of the shaft 13, only one of which is shown in FIGS. 1 and 2, uncovered by the sleeve 14. Ends 15 of shaft 13 are machined to provide assured seating and retention in and mounting to a pair of shaft support blocks 16. Blocks 16 conventionally have extending pad portions 18 in which holes are provided for mounting the blocks to a frame apparatus (not shown) using securing members 20 which in one embodiment are screw bolts although suitable fasteners may be used. Blocks 16 in one embodiment may be of a clamping type that enables the position of the roller assembly 12 to be more easily adjusted to accommodate web materials having different dimensions and travel path requirements.

Roller assembly 12 in the embodiment includes a multiplicity of rubber discs 22 which are rotatably mounted and are arrayed in disc style about the outer surface of shaft 13 on a rotatable tubular support 24. Discs 22 are arranged so that the exterior surfaces of the discs 22 engage with and generally support the interior diameter of the resilient sleeve 14 and are rotated therewith. The discs are spaced from each other and accommodate the lateral expansion and contraction of the resilient sleeve 14 as provided by the settings of each end cap sub-assembly 10. It will be understood however that the end cap sub-assembly 10 can be utilized with stretch rollers having different constructions than the one just described.

As shown in FIG. 2, end section 15 of shaft 13 is machined to include a short reduced diameter section 32 and forming a lip 33 between the main section 34 of the shaft 13 and reduced diameter section 32. In addition, a further reduced diameter section 36 is provided, forming another lip 37 between reduced diameter sections 32 and 36. Each stretch end cap sub-assembly 10 includes a clamping assembly which grippingly holds and retains an end of flexible sleeve member 14 of roller assembly 12. In addition, a pivot assembly is provided to selectively adjust the angular displacement of each end cap sub-assembly with respect to the longitudinal axis or axis of rotation of fixed shaft 13 as well as the expansion and contraction of sleeve member 14 within a 360 degree rotation of the sleeve 14. A preload assembly is also provided which allows the tension of the sleeve 14 to be adjusted during initial setup and then adjusted as needed during operation of the roller assembly 12. In an embodiment, the majority of the components of sub-assembly 10 are made of a metal such as stainless steel.

More particularly, end cap sub-assembly 10 includes an outer bearing ring 40 having a cylindrical section 42 and an annular outwardly flanged lip 44 situated on an end of the cylindrical section 42. In addition, an annular groove 46 is provided on the inner surface of cylindrical section 42 at a position spaced apart from flanged lip 44. An inwardly directed flange 48 having a predefined width and a plurality of spaced-apart threaded through-holes 49 is also provided on the end of cylindrical section 42 opposite outwardly flanged lip 44. In an embodiment, there are eight spaced-apart through-holes 49 in inwardly directed flange 48.

Outer bearing slide ring 50 is dimensioned to be positioned against the outer surface of cylindrical section 42 of outer bearing ring 40. Slide ring 50 has a cylindrical configuration with an inner surface 52 and a plurality of spaced apart through-apertures 54 extending laterally there through. In an embodiment, there are four through-apertures 54. In addition, slide ring 50 has an outer circumferential edge surface 56 50 which includes several spaced-apart grooves 57, giving edge surface 56 a jagged or knurled profile which forms part of the sleeve clamping assembly of the end cap sub-assembly 10 and aids in retaining sleeve member 14 as illustrated in FIG. 1 and explained in greater detail below. A ring-shaped outer bearing ring bearing 58 is also provided which is dimensioned to be inserted and secured in outer bearing ring 42.

Pivot arm assembly 60 is generally formed as a short cylindrical tube or collar having a center bore 61 with a diameter larger than the diameter of end 15 of the shaft 13 and sufficient for the end cap sub-assembly 10 to be angularly displaced or laterally tilted a predetermined maximum angle with respect to the longitudinal axis of stationary shaft 13. An annular flange 62 is provided on one end of pivot arm 60, and a threaded aperture 63 transverse to the longitudinal axis of the pivot ring 60 is positioned near the end opposite flange 62. The aperture 63 is adapted to receive a securing member 64 such as a threaded bolt or screw which is inserted in the aperture 63, and by adjusting the position of securing member 64 in aperture 63 the angle of the pivot arm 60 and therefore the angular displacement of end cap sub-assembly 10 can be adjusted. Securing member 64 in an embodiment should be of a type which is lockable in the aperture to maintain the set position of pivot arm 60. A circumferential groove 66 is also formed on the exterior surface of pivot arm cylindrical section 60 at a position spaced apart from annular flange 62, and a pair of spaced transverse threaded apertures 67 is provided in pivot arm 60 near annular flange 62 on opposite sides of the pivot arm 60 in which fasteners such as set screws are inserted to pivotally secure the pivot arm 60 to shaft 13, during assembling of the end-cap sub-assembly. Also provided are a pair of spring clips or internal and external retaining rings 68 and 69, and set screws 72, the purpose of which will become evident from the following description.

As an initial step in a method of assembling the end cap sub-assembly 10 on an end 15 of shaft 13 of roller assembly 12, pivot arm 60 is inserted over the reduced end portion 32 of shaft 13 with annular flange portion 62 facing inwardly. Pivot arm 60 is then secured to shaft 13 by set screws which are passed into the lateral apertures 67 in pivot arm 60 so that they are pressing against the outer surface of shaft 13. Before the set screws are completely tightened, a temporary centering piece or fixture (not shown) is placed over shaft 13 and positioned in the center bore 61 between the inner cylindrical surface of pivot arm 60 and reduced portion 32 of shaft 13. The fixture is dimensioned so that the pivot arm 60 is centered with respect to shaft 13 when the fixture is being used, after which the set screws are further tightened in order to secure the pivot arm 60 in such position, with pivot arm 60 being pivotable on the set screws with respect to shaft 13.

Outer bearing ring bearing 58 is then inserted into outer bearing ring 40 and positioned between annular groove 46 and flange 48, where it is maintained by snap ring 68 which is then secured in annular groove 49. The combined outer bearing ring 40 and outer bearing ring bearing 58 structure is inserted over end 15 of shaft 13 and, preferably with the centering fixture still in place, is press-fitted on pivot arm 60 with flanged section 44 of the outer bearing ring 40 facing inwardly, and annular flange portion 62 of pivot arm 60 abutting against lip 33. Adjustment screw 64 of pivot arm 60 is then tightened against the centering piece to ensure that the outer end of pivot arm 60 is properly centered, and the outer bearing ring 40, outer bearing ring bearing 58, and pivot arm 60 combination is further forced onto reduced diameter section 32 of shaft 13, such as by using a mallet and intermediate force directing member until flanged section 44 of outer bearing ring 40 is aligned against lip 33 of shaft 13. Spring clip 69 is then inserted over pivot arm 60 into circumferential groove 66, securing outer bearing ring 40 in position over pivot arm 60 such that the outer bearing ring 42 is rotatable on outer bearing ring bearing 58 with respect to pivot arm 60. Thus, when pivot arm 60 is pivoted with respect to shaft 13, outer bearing ring 40 is also caused to pivot. In addition, when the resilient sleeve 14 is attached to the end cap sub-assembly 10 using the sleeve clamping assembly of the invention in the manner to be described, and the pivot arm 60 is tilted, a section of the sleeve 14 around its circumference is expanded, while another section is contracted.

Outer bearing slide ring 50 is then positioned over the outer surface of cylindrical section 42 of the outer bearing ring 40 so that it is flush against outwardly flanged section 44. As shown in FIG. 1, an end of the resilient sleeve 14 is then positioned over the circumferential edge surface 56 of outer bearing slide ring 50. A ring-like sleeve clamp 80 is then positioned over or around the end portion of rubber sleeve 14 over the circumferential edge surface 56 of the outer bearing slide ring 52. Sleeve clamp 80 includes an inwardly directed lip 81 connected along one edge, and a plurality of sleeve sections 82 which are separated by longitudinal slots 83 extending between the sleeve sections 82, and the sleeve section 82 may be angled slightly outwardly, making it easier to insert the clamp 80 over the end of sleeve 14. In addition, as shown in FIG. 1, in one embodiment the inner surface 84 of the sleeve sections 82 is thicker along outer edge 85 than at lip 81. The thicker outer edge 85 gives the inner surface 84 an inwardly tapered profile from lip to outer edge 85, which aids in maintaining the sleeve 14 in the clamping assembly between the outer circumferential surface 56 of outer bearing slide ring 50 and inner surface 84 of slide ring 80.

An end cap 90 having a cylindrical section 92 and an inwardly directed flange 94 on one end including a plurality of spaced through-apertures 95 is provided. In one embodiment, there are four through-apertures 95, and in addition in an embodiment there is at least one alignment aperture 96. End cap 90 is slid over end 15 of the shaft 13 with flange 94 directed outwardly, and then over the outer surface of sleeve clamp 80. Through-apertures 95 are aligned with the apertures 54 in outer bearing slide ring 52. In an embodiment, an external fixture 100 is used to aid in inserting end cap 90 over sleeve clamp 80 so that it is straight, and the end cap 90 is slowly pressed on to sleeve clamp 80. More particularly, fixture 100 is dimensioned to fit temporarily over end 15 of shaft 13 and then over the outer surface of end cap 90, and includes an inner ring section 102 that is sized to receive the end of cylindrical section 42 of outer bearing ring 40, and an outer ring section 104 that fits against the outer surface of flange 94 of end cap 90. A plurality of spaced apart through-apertures 106 are provided on inner ring section 102 which when fixture 100 is properly positioned are aligned with apertures 49 in flange 48 of outer bearing ring 40. In addition, an alignment or locating pin hole and pin 108 are provided which aid in properly aligning end cap 90 over sleeve clamp 80. Fasteners 108 are passed into apertures 102 of fixture 100 and then into apertures 51 of outer bearing ring 42. As the fasteners 108 are gradually and sequentially tightened, end cap 90 is pulled downwardly over sleeve clamp 80. This causes sleeve clamp 80 to be compressed, with slots 83 being narrowed until the edges of sleeve sections 82 are abutting or almost in abutment, which allows the overall diameter of the sleeve clamp to be reduced as it is compressed.

A coupler ring 110 is also provided, which is secured over the outer end of end cap 90 after the end cap 90 has been tightly mounted over compression sleeve 80 and fitting 100 has been removed. Coupler ring 110 has an outer surface 112 and an inner surface 114. Inner surface 114 includes an inner ring section 116 having a first diameter and an outer ring section 118 having a second diameter. Spaced apart apertures 120 are provided in inner ring section 116 extending between outer surface 112 and inner surface 114. Similarly, spaced apart apertures 122 are provided in outer ring section 118 which are aligned with apertures 120 in inner ring section 116, and also are aligned with apertures 54 in slide ring 50. Coupler ring 110 is inserted over end 15 of shaft 13 with inner surface 114 facing inwardly, inner ring section 116 is aligned against the outwardly facing surface of flange 48 of outer bearing ring 40, and apertures 120 are aligned with apertures 49 in flange 48 of the outer bearing ring 40, and apertures 122 are aligned with apertures 54 in slide ring 50. Fasteners 124 which may be button head cap screws including lock washers are then inserted in apertures 120 in inner ring section 116 and are passed into apertures 49 in flange 48 of outer bearing ring 40 and secured. Fasteners 126 which may also be button head cap screws including lock washers are then passed into apertures 122 in outer ring section 118, apertures 95 in end cap 90, and then into apertures 54 of outer bearing slide ring 50.

Once the combined pivot arm and bearing ring assembly (40, 50, 60) is mounted to shaft 13, in order to secure the rubber sleeve 14, as indicated above, an end of rubber sleeve 14 is placed over circumferential edge surface 56 of outer bearing slide ring 50. Ring-like sleeve clamp 80 is then placed over and around the end portion of rubber sleeve 14 located over circumferential edge surface 56 of outer bearing slide ring 50. The end cap 90 is then secured over sleeve clamp 80 in the manner described above, preferably using external fixture 100, which creates compression of the sleeve clamp and in turn causes the portion of rubber sleeve 14 between the outer surface 56 of outer bearing slide ring 50 and sleeve clamp 80 to be compressed. In particular, the knurled surface 57 of circumferential edge surface 56 of ring 52, combined with the inwardly tapered inner surface 84 of each of the sleeve sections 82 of sleeve clamp 80 (see FIG. 1), which are allowed to bend inwardly or closer together due to slots 83 between the sleeve sections 82, securely holds the end of rubber sleeve 14 when compressed.

Figure 3:
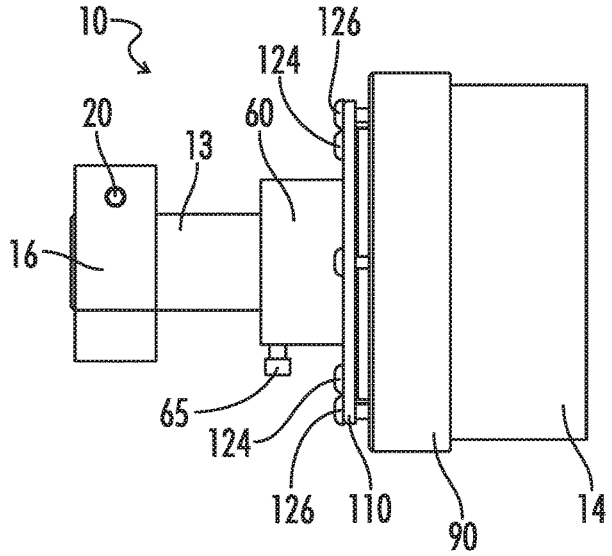
FIG. 3 is a side elevation view of the stretch end cap sub-assembly shown in FIG. 1 connected with a sleeve in an unstretched position.
Figure 4:
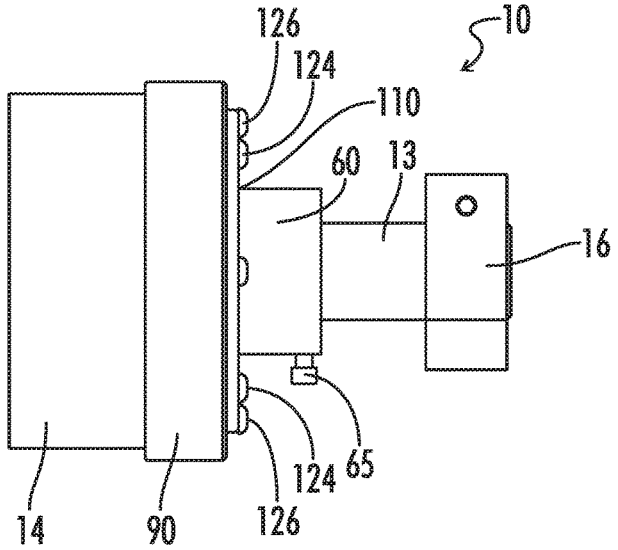
FIG. 4 is a side view of the stretch end cap sub-assembly shown in FIG. 1 connected with a sleeve in a stretched position.

FIGS. 3 and 4 illustrate the manner of operation of the preloading feature of the present invention which allows the longitudinal tension of sleeve 14 to be adjusted within a range so that it fits properly and tightly on the support disc. FIG. 3 illustrates a first end cap sub-assembly to which one end of sleeve 14 is secured, while FIG. 4 illustrates a second end cap sub-assembly to which the other end of sleeve 14 is secured. The adjustments can be made during initial setup of the stretch roller assembly, as well as during operation of the wrinkle removing roller assembly, without requiring removal and remounting of the flexible roller, and with very little machine down time. In one embodiment, a stretch end cap sub-assembly is provided on both ends of a resilient sleeve 14, each of which is capable of stretching the resilient sleeve 14 laterally about one-quarter inch, or a total of about one-half inch.

As indicated above, coupler ring 110 is rigidly secured to flange 48 of outer bearing ring 40 by fasteners 124 which are passed through apertures 120 in inner ring section 116 of coupler ring 110 and also into apertures 49 in flange 48 of outer bearing ring 40. In this initial position, outer ring section 118 of coupler ring 110 is spaced apart from outer bearing slide ring 50 a distance approximately equal to the width of inner ring section 116 of coupler ring 110. Outer bearing slide ring 50 is slidably mounted on cylindrical surface 42 of outer bearing ring 40, and thus can slide laterally, or parallel to the axis of the stationary shaft 13, on outer cylindrical surface 42. Outer bearing slide ring 50 may be caused to slide laterally outwardly on cylindrical surface 42 outer bearing ring 40 by turning head cap screws 126 which are passed through apertures 122 in coupler ring 110, apertures 95 in end cap 90 and into apertures 54 in slide ring 50 in a first direction, normally clockwise.

More particularly, as shown in FIG. 3, screws 126 are shown in a rotated outwardly position with respect to coupler ring 110, such that end cap 90 and outer bearing slide ring 50 underneath are spaced apart from the coupler ring 110. This is the preferred position of the coupler ring assembly when a rubber sleeve 14 is initially secured between outer bearing slide ring 52 and sleeve clamp 80. Then, as shown in FIG. 4, when it is desired to increase the tension on rubber sleeve 14, fasteners 126 are turned such that they are directed inwardly with respect to coupler ring 110. Fasteners 126 as a result extend further inwardly into threaded apertures 54 in outer bearing slide ring 50, which causes the outer bearing slide ring 52 and end cap 90 to be pulled or slide laterally outwardly towards coupler ring 110 on the outer cylindrical surface 42 of outer bearing ring 40. In turn, sleeve 14 is also moved outwardly, which increases the tightness or tension on sleeve 14.

In addition to the preload assembly being used to adjust the overall tension on rubber sleeve 14, the pivot assembly is used to expand and contract sections of the sleeve 14 in order to achieve a wrinkle removing effect. The hollow cylindrical center of the pivot arm 60 fits over end 15 of shaft 13 such that the pivot arm 60 is encircling end 15 with a predetermined distance or clearance separating the outer surface of end 15 from the inner cylindrical surface of pivot arm 60. The percent of end cap sub-assembly displacement combined with the wrap angle of the web material on roller 14 allows the percent spread of the web material to be custom adjusted according to requirements. Pivot arm assembly 60 therefore provides a mechanism for tilting the end cap sub-assembly and thereby also stretching one portion of the circumferential surface of the rubber sleeve 14 while contracting the opposite surface.

In FIG. 1, pivot arm 60 and the rubber sleeve 14 are shown in a straight or non-tilted position, with adjustable bolt member 64 in contact with end section 15 of shaft 13, which prevents any tilting. In order to adjust the angle or tilt of the end cap sub-assembly 10, bolt member 64 is rotated so that it is moved further inwardly in aperture 63 and to compensate for this increase inwardly rotation the cylindrical pivot arm 42 is angled towards the bolt member 64. It is to be realized that the pivot actuation or tilt is diametrically opposite to the desired stretch of the outer rubber sleeve 14. The amount of tilt is adjustable to suit the required conditions of the traveling web, with a maximum amount of tilt being provided when bolt member 64 is turned into aperture 63 until the opposite side of the pivot 60 is pressing against shaft 13, and with a multitude of intermediate tilt angles at which sub-assembly 10 may be positioned being available. It will also be understood that one end cap sub-assembly 10 may be tilted while the other end cap assembly 10 is not tilted. Other pivot arrangements may be utilized with the sleeve locking collar of the present invention.

The end cap sub-assembly 10 thus provides different means of adjusting the amount of tension on the ends of a stretch roller assembly 12, and more particularly on a rubber sleeve 14. Where end cap sub-assembly 10 is utilized on both ends of a rubber sleeve 14 the sleeve 14 can be stretched laterally the same amount on both ends or different amounts in the manner described using the preload assembly described herein to adjust the position of outer bearing slide ring 52. The position of outer bearing slide ring 52 may be adjusted to an initial position, which can later be easily changed to increase the amount of uniform tension on the end of sleeve member 14. In addition, once the initial position of outer bearing slide ring 52 is set, pivot arm 60 may be operated to change the angular displacement of the end cap sub-assembly 10 which will give the roller an expanded sleeve side and a contracted sleeve side. The web material having wrinkles in the material will be fed on to sleeve member 14 such that its initial contact point with the resilient sleeve member 14 is with the contracted sleeve side, and such that the web material is removed from contact with the sleeve on the expanded sleeve side of the sleeve 14. The traction of the web material with the surface of the sleeve member 14 will cause the web material to expand or stretch out as it passes over the roller, removing wrinkles in the web material. It will also be understood that where the end cap sub-assembly 10 is used on both ends of rubber sleeve 14, one end cap assembly may be tilted while the other end cap assembly is not tilted, or the different end cap assemblies may be set at different angles as needed. The outer sleeve 14 portion therefore is adjustable so that a desired spread of the traveling web may be achieved by the roller without a distortion of the web as with a curved roller.

The end cap sub-assembly of the invention therefore incorporates a slide mechanism for preloading a rubber outer sleeve of a roller assembly, which slide mechanism is built directly onto the end cap, unlike the slide-rod arrangement or other arrangements found in prior stretch mechanisms. In an embodiment, the inventor has therefore devised in accordance with the invention a new apparatus and method of capturing, clamping, and pre-loading a stretch roller assembly rubber sleeve 14 between the end caps of the roller assembly. This stretch end cap sub-assembly design improves over the slide rod arrangement of the prior art, since it allows for adjustments to be made from each end independently, and can be made while the web is in motion using standard tools. In addition, the present invention is easier to use and is less costly both in terms of manufacture of parts and maintenance as well as in production costs due to the amount of time a stretch roller assembly is inoperative due to downtime related to maintenance of the machine.

In a preferred embodiment of the present invention, the end cap subassembly is adapted primarily for use with a bowless-type spreader roller. A roller of this type is preferred over a bowed-type roller as a bowless-type roller helps reduce stressed and/or torn web center areas, as well as an altered centerline travel, and will not introduce new wrinkles into the web material. Further, where the web material is to be fed to other level sensitive devices such as moisture or weight meters, the current assembly prevents the introduction of non-level web material into such assemblies. In an embodiment the apparatus or frame carrying the roller is conventionally provided with adjusting means so that the wrap of the web on the roller may be as little as light contact to as much as full contact of one hundred eighty degrees. However, different mounting arrangements may be utilized, as well as different sleeve materials while still falling within the intended scope of the invention.

In accordance with embodiments of the invention, a primary feature is that no special tools are needed to adjust the degree of the spreading action performed by the expanding surface roll as such adjustment can be achieved by the invention itself. Another feature in accordance with embodiments of the invention is that the end cap sub-assembly has a versatile shape such that it can allow spreader rollers with such end cap sub-assemblies to directly replace existing or competitor wrinkle removing rolls or idlers. Additionally, the present invention allows independent edge to edge adjustability of the roller to be realized while the web is in motion. The degree of expansion can be quickly altered at each cap, allowing correction of any distortion that may have been produced at earlier points in time, thus providing total control of spreading action needed to meet industry needs and requirements.

Use of the stretch end cap sub-assembly thus provides a no-bow spreader roller assembly with edge-to-edge adjustability while a fast-moving web is in motion. A gentle expansion and/or contraction of the rubber sleeve thus promotes positive yet nondistorting wrinkle and sag removal. The fixed stretching provided by curved rollers or grooved rolls promotes web stretch at the center of the web but is not present in the present roller assembly as the ends of the present roller can be and are adjusted so that differing spread characteristics are achieved. One edge, for example, may be adjusted for dramatic spreading while the other edge portion may have only a shallow wrinkle or two, requiring only light spreading action. This end cap sub-assembly and roller assembly is contemplated for narrow webs as well as very wide webs, and also can be used with roller sleeves having different diameters and to run high-heat applications and in vacuum chambers.

While the present invention has been described at some length and with some particularity with respect to the several described embodiments, it is not intended that it should be limited to any such particulars or embodiments or any particular embodiment, but it is to be construed with reference to the appended claims so as to provide the broadest possible interpretation of such claims in view of the prior art and, therefore, to effectively encompass the intended scope of the invention.

What is claimed is:

1. An end cap sub-assembly for a spreader roller including a fixed shaft comprising:

an outer bearing ring and bearing assembly, said assembly including an outer bearing ring having a cylindrical section including an inner surface and an outer surface, an outwardly directed flange on an end of the cylindrical section, and an inwardly directed flange on another end of the cylindrical section, a ring-shaped outer bearing ring bearing dimensioned to be secured in the cylindrical section of the outer bearing ring, and an outer bearing slide ring which is slidable parallel to an axis of the fixed shaft against the outer surface of the cylindrical section of the outer bearing ring, said outer bearing slide ring having an outer circumferential edge surface; and a clamping assembly for securing an end portion of a sleeve member forming part of the spreader roller to the end cap sub-assembly against the outer circumferential edge surface of the slide ring, the clamping assembly including a segmented sleeve-like clamping ring and an end cap, said clamping ring being dimensioned to fit over the outer circumferential edge surface of the slide ring with the sleeve member end portion positioned over said outer circumferential edge surface, and the end cap being securable over the clamping ring when positioned over the outer circumferential edge surface of the slide ring and sleeve member end portion in order to clamp the sleeve member end portion between the clamping ring and outer circumferential edge surface of the slide ring.

2. An end cap sub-assembly for a spreader roller in accordance with claim 1 in which the outer circumferential edge surface of the outer bearing slide ring includes a knurled surface.

3. An end cap sub-assembly for a spreader roller in accordance with claim 2 in which the clamping ring is comprised of a plurality of segmented sleeve sections connected on one end and separated by slots extending between the sleeve sections from the connected end to an outer end of the sleeve sections, and a lateral inwardly directed flange provided on the connected end of the ring.

4. An end cap sub-assembly for a spreader roller in accordance with claim 3 in which the sleeve sections have an inner surface, said inner surface being tapered inwardly from the connected end to the outer end of the sleeve sections.

5. An end cap sub-assembly for a spreader roller in accordance with claim 4 in which the end cap includes a cylindrical section and an inwardly directed flange on one end of said cylindrical section.

6. An end cap sub-assembly for a spreader roller in accordance with claim 5 additionally comprising a preload assembly including a coupler ring operatively connected by one or more fasteners over the end cap and to the clamping assembly outer bearing slide ring for selectively adjusting the linear position of the outer bearing slide ring on the circumferential outer surface of outer bearing ring in order to adjust the tension on the sleeve member both during initial setup and operation of the spreader roller as needed.

7. An end cap sub-assembly for a spreader roller in accordance with claim 6 additionally comprising a pivot arm assembly for adjusting the angular displacement of the end cap sub-assembly with respect to said axis of the fixed shaft, the pivot arm assembly being selectively sized for a predetermined loose fit on an outer portion of a tubular cross section of said fixed shaft, and said outer bearing ring and bearing assembly being mounted to said pivot arm assembly.

8. An end cap sub-assembly for a spreader roller in accordance with claim 7 in which the pivot arm assembly includes a cylindrical section and an annular flange section on one end of the cylindrical section, the cylindrical section having an outer surface and a circumferential groove in the outer surface spaced from the annular flange section, a pair of transverse apertures in the cylindrical section positioned near the annular flange section for securing the pivot arm assembly to the fixed shaft, and a transverse aperture in the cylindrical section near an end opposite the annular flange section for receiving an adjustable securing member.

9. An end cap sub-assembly for a spreader roller in accordance with claim 8 in which the outer bearing ring is secured over the cylindrical section of the pivot arm assembly by a retaining ring inserted in the circumferential groove in the outer surface of the cylindrical section.

10. An end cap sub-assembly for a spreader roller in accordance with claim 9 in which the coupler ring includes an inner ring section containing a plurality of spaced apart apertures, and an outer ring section containing a plurality of spaced apart apertures aligned with said apertures on the inner ring section.

11. An end cap sub-assembly for a spreader roller in accordance with claim 10 in which the outwardly directed flange of the outer bearing ring additionally includes a plurality of spaced-apart apertures which are in alignment with the apertures on the inner ring section of the coupler ring.

12. An end cap sub-assembly for a spreader roller in accordance with claim 11 in which the apertures in the outer ring section of the coupler ring are aligned with laterally extending through-apertures in the outer bearing slide ring and through-apertures in the inwardly directed flange of the end cap, whereby fasteners passed into said aligned apertures when turned in a tightening direction cause the outer bearing slide ring to slide laterally outwardly on the outer surface of the cylindrical section of the outer bearing ring, increasing the tension on the sleeve member.

13. An end cap assembly for a spreader roller in accordance with claim 12 in which as the angular displacement of the pivot arm assembly is adjusted a first portion of the sleeve member is contracted and a second portion of the sleeve member is expanded.

14. An end cap sub-assembly for a spreader roller in accordance with claim 1 in which the fixed shaft is supported on a pair of shaft support blocks.

15. An end cap sub-assembly for a spreader roller in accordance with claim 14 in which the sleeve member is comprised of neoprene.

16. An end cap sub-assembly for a spreader roller in accordance with claim 14 in which the spreader roller additionally comprises a plurality of spaced apart discs mounted and arrayed in a disc style about the fixed shaft on a rotatable tubular support and in a supporting position with respect to the sleeve member and accommodating lateral expansion and contraction of the sleeve member.

17. An end cap sub-assembly for a spreader roller in accordance with claim 7 in which an end of the fixed shaft connected to said end cap sub-assembly is provided with at least one reduced diameter section on which the pivot arm assembly is secured.

18. An end cap sub-assembly for a spreader roller in accordance with claim 5 additionally comprising an external fixture used to aid in aligning and securing the end cap over the clamping ring.

19. An end cap sub-assembly for a spreader roller in accordance with claim 1 which is secured to both ends of the fixed shaft.

* * * * *